US007841805B2

(12) United States Patent
Chugh

(10) Patent No.: US 7,841,805 B2
(45) Date of Patent: Nov. 30, 2010

(54) ENGINEERED COMPOSITE WOODEN CRIB FOR USE AS A MINE SUPPORT

(75) Inventor: Yoginder Paul Chugh, Murphysboro, IL (US)

(73) Assignee: Board of Trustees of Southern Illinois University, Carbondale, IL (US)

( * ) Notice: Subject to any disclaimer, the term of this patent is extended or adjusted under 35 U.S.C. 154(b) by 664 days.

(21) Appl. No.: 11/900,486

(22) Filed: Sep. 12, 2007

(65) Prior Publication Data

US 2010/0221073 A1 Sep. 2, 2010

(51) Int. Cl.
*E21D 15/00* (2006.01)

(52) U.S. Cl. ..... 405/273; 405/288

(58) Field of Classification Search ..... 405/273, 405/272, 288

See application file for complete search history.

(56) References Cited

U.S. PATENT DOCUMENTS

| | | | | |
|---|---|---|---|---|
| 1,749,303 | A * | 3/1930 | Rutter | 405/273 |
| 2,123,016 | A * | 7/1938 | McDaniel | 405/273 |
| 4,628,658 | A | 12/1986 | Erasmus | |
| 4,664,358 | A * | 5/1987 | Clark | 405/273 |
| 4,712,947 | A | 12/1987 | Thom | |
| 5,435,670 | A | 7/1995 | Pienaar | |
| 5,746,547 | A | 5/1998 | Reinmann | |
| 5,868,527 | A | 2/1999 | King | |
| 6,079,910 | A | 6/2000 | Marianski | |
| 6,250,849 | B1 | 6/2001 | Marianski | |
| 6,277,189 | B1 | 8/2001 | Chugh | |
| 6,352,392 | B1 | 3/2002 | McCartney | |
| 6,729,806 | B1 | 5/2004 | Knight | |
| 2003/0068204 | A1 * | 4/2003 | Paton-Ash et al. | 405/273 |

* cited by examiner

*Primary Examiner*—Frederick L Lagman
(74) *Attorney, Agent, or Firm*—Mark E. Stallion; Husch Blackwell LLP

(57) ABSTRACT

This invention provides improvements through 1) a composite, engineered wooden support element for construction of cribs in mines to provide support between two surfaces, 2) use of support elements to construct cribs, and 3) a wedge system to provide substantial sustained preload on a crib. The wooden support element consists of a center elongate element wherein the wood grain runs transversely to the crib element loading direction, and at least two outer plate elements wherein the wood grain runs axially with the crib element loading direction. Each outer plate element is attached to a surface of the center elongate element using fastening means and the outer plate element wood grain direction is aligned transversely to the grain direction in the center elongate element. The crib structure may be constructed by superimposing only these support elements in 2×2 layers or in conjunction with solid prismatic wooden elements. A wooden wedge system with relatively low angle surface and with wood grain running axially is utilized to apply vertical preload. Due to high stiffness of the wedge in the axial direction, a substantial vertical preload can be applied and sustained to make cribbing structure a more efficient load carrying structure. The wooden support elements are lightweight, have controllable higher stiffness and load carrying capacity than current cribs, engineered yielding characteristics and allow much lower resistance to air flow in underground mine roadways.

18 Claims, 20 Drawing Sheets

Elevation View

Elevation View

Elevation View

Stress- Strain plot for a 6-inch cubical wood block loaded in z-direction

Stress- Strain plot for a 6-inch cubical wood block loaded in x-direction

Stress- Strain plot for a 6-inch cubical wood block loaded in y-direction

Stress- Strain plot for a 6-inch X 6-inch Engineered Composite crib element for configuration in Figure 4.

Stress- Strain plot for a 6-inch X 6-inch Engineered Composite crib element for configuration in Figure 6.

Disclosed Art

ENGINEERED COMPOSITE WOODEN CRIB FOR USE AS A MINE SUPPORT

FIELD OF INVENTION

The invention relates primarily to mining, and more specifically to wooden cribbing for the support of hanging wall and foot wall, roof and floor, or upper and lower surfaces in underground mining, and secondarily to the temporary support of heavy structures such as houses or buildings being relocated or receiving foundation work.

BACKGROUND OF INVENTION

Wooden posts and wooden cribs, or chocks, are probably the oldest support systems used in the mining industry. A wooden post, typically 4 inches to 10 inches in diameter or square cross-section, loaded axially provides support between two points. A wooden crib or chock provides support over a larger area, typically varying from a 30 to 72 inches square. Wooden posts and wooden cribs are extensively used in the mining industry even today.

A wood crib consists of layers of two or more parallel timbers with adjoining layers placed at right angles to each other, as shown in FIG. 1. Thus, the number of parallel timbers in each direction determines the number of contact areas through which load is transferred or resisted. For example, a 2 by 2 crib means two layers of timber in each direction, resulting in 4 contact areas. A 2-by-2 crib configuration is most common, although 3-by-3, 3-by-2, and 4-by-4 configurations have been considered and have found limited application.

Underground mines use large number of wooden cribs to provide support over an area between two opposing surfaces. These opposing surfaces are referred to in industry conventions alternatively as to the lower surfaces in mines as floors, footwalls, and as to the upper surfaces as roofs and hanging walls. Typically, cribs are more extensively used in longwall coal mining than in room-and-pillar coal mining. Cribs are also extensively used in non-coal underground mining.

A crib is typically constructed of wooden elements of square or prismatic cross-section, 5 to 6 inches across, although other shapes have also been used. The length of elements used typically varies from 30 inches to 60 inches, depending upon the height of the area to be supported. Aspect ratio for a crib is defined as the ratio of the height of the crib to the distance between centers of contact areas along a timber. Reducing aspect ratio increases the stability of the crib structure, and ratios larger than 2.5 and less than 4.3 are recommended. A crib structure should be designed to have appropriate rigidity, or stiffness, and load carrying capacity to provide early, controlled resistance to rock mass movement to maintain its integrity.

A typical crib uses solid, prismatic wooden crib elements of 5"-by-5"-by-30" or 6"-by-6"-by-36", although other sizes may be used. The load is transferred between upper and lower surface areas through typically four contact areas in a horizontal plane of the size 5"-by-5" or 6"-by-6" depending on the size of the crib element. Except at and around the contact areas, there is very little stress within the prismatic element. The areas adjacent to the contact areas are in tension while zones away from contact areas have almost no stresses vertically or horizontally. At and below the contact areas are high compressive stresses.

Wood is a transversely isotropic material with much higher strength and stiffness when loaded axially, or parallel to the grain, as compared to loading transversely, or perpendicular to the grain. More specifically, a typical oak timber loaded axially has a compressive strength of 2000-2500 psi, and an elastic modulus of 150,000-250,000 psi. Similar data for the two lateral loading directions are about equal to each other, and are 500-700 psi in compressive strength and 25,000-35,000 psi elastic modulus. Furthermore, the Poisson's ratios for loading in the axial and lateral directions are also significantly different: 0.10-0.20 for loading axially and 0.30-0.40 for loading in the two lateral directions. The wood and numbers here are provided as an example and these may vary.

A typical solid wood cribbing for support has several shortcomings. First, its rigidity is low since wood is loaded at right angles to grain. So, the support column allows a significant amount of deformation, as much as 20% of the total height of the column may be reduced through deformation. Second, because of deformations, the column has limited load carrying capacity, since typical columns are subject to failures from buckling before achieving their full load carrying capacity. Third, air flow in mines is important, and since each cribbing column eliminates about half the available air flow space when installed, because the air is displaced by crib elements, resistance to air flow is significant. Fourth, installing typical solid wood cribbing is difficult in locations where the surfaces are not parallel to each other or irregular. Fifth, each wooden crib element typically weighs about 35 pounds, making carrying them by hand and assembling a cribbing column an arduous process, especially when one must lift above one's head to reach the upper layers. Sixth, since low-rigidity wedges, cut parallel to the wood grain, are typically used to preload the crib, the amount of preload force that can be introduced to a column is limited. The wedges typically deform under light loads, which means the column does not support significant loads until the upper and lower surfaces have collapsed toward each other, compressing the column. Preloading is currently applied through wooden wedges, typically 3 to 4 inches wide that are cut at high incline angles of 10 to 20 degrees. These wedges are loaded transversally to the wood grain and yield at the low pressure of 500 to 700 psi. Since wedges are cut at high incline angles, their contact areas with prismatic crib elements are small. Therefore, stress concentrations at contact points are high and the wedges yield even at low crib loads. The wedges then become loose providing little or no preload on the installed crib. Industry professionals suggest that there is a need to develop a relatively simple mechanism to apply a sustained preload of 5 to 8 tons when a crib is installed.

U.S. Pat. No. 6,352,392 describes a mine roof support crib. The crib includes a plurality of chocks that are connected together through notches in the chocks to form only three planes with at least two of the planes in perpendicular relation with each other and able to support at least five tons of load. Alternatively, the plurality of chocks that are connected together through notches in the chocks form only two planes which are in perpendicular relation with each other and are able to support at least five tons of load. The invention uses solid wood elements, and when assembled forms surfaces through which air flow are not possible. Furthermore, the elements are loaded transversally, requiring more material to support a given load.

U.S. Pat. No. 5,746,547 is concerned with a mine support crib of the type which comprises a series of superimposed layers of elongate chocks. There is a plurality of parallel, spaced apart chocks in each layer with the chocks in one layer arranged transversely to the chocks in the adjacent layer or layers so that the chocks in a given layer, other than the bottom layer, cross the chocks in the layer below at crossing points which are located inwardly of the ends of the chocks.

According to the invention, operatively upper and lower surfaces of the chocks are formed with notches at the crossing points. The notches interlock with one another to lock the chocks together. The notches are of such depth that portions of the chocks which are located between and beyond the notches bear on corresponding portions of chocks in the next layer but one below. The invention has the disadvantage of creating vertical surfaces which are impervious to air flow, and which utilize significant amounts of timber to support a given load, in part because the crib elements are loaded transversally to the grain direction.

U.S. Pat. No. 5,435,670 describes a method and apparatus for providing a crib type yielding support between two areas in mines. The support consists basically of three elements: a spacer, a pack, and a grout-inflatable bag. The spacer is designed to be stiffer than the pack. The pack is designed to have lower stiffness and yield under loading. As the name implies, the spacer basically fills in the height to maintain the slenderness ratio within limits. A spacer may consist of interconnected elongate timbers side-by-side such that loading on it is parallel to the wood grain. Another spacer configuration taught by the patent includes forming a layer of timbers with some elongate timbers with wood grain parallel to loading and others perpendicular to loading. Multiple layers are stacked on the top of each other with multiple contact points through which load is transferred. The pack also consists of network of elongate timbers laid out in a manner that the pack has low stiffness and is much more compressible than the spacer and has yielding characteristics. A grout-inflatable bag is used to provide a preload to the entire system by expanding against the roof or the floor in a coal mine or the hanging wall and the footwall in coal or non-coal mine. The inflatable bag conforms to uneven roof and applies preload to the support assembly. The invention also uses significant amounts of raw materials to create surfaces through which air flow is not possible, because the elements must abut and be interconnected to each other to resist buckling. Also, each layer of spacer is preformed and transported to installation site. For such a crib assembly, material handling is difficult because of the weight and size of the pre-assembled structure.

U.S. Pat. No. 4,628,658 discloses an interconnected cribbing system. The described cribbing system for supporting a mine roof or the like includes a multi-sided column. Each column is formed of a stack of cribbing elements with each cribbing element having upper and lower surfaces wherein substantially the entire upper and lower surface of each cribbing element is a bearing surface for transmitting a substantially vertical load to a vertically adjacent cribbing element of one stack. The majority of loading forces are transmitted in this invention transverse to grain direction, and the structure creates a vertical surface that obstructs airflow, however.

SUMMARY OF INVENTION

The proposed engineered composite wooden crib element is a composite with some or all pieces of wood in the composite loaded axially. One embodiment of the engineered composite wooden crib element uses outer plate elements, which consist of four, 5.75"-by-5.75"-by-1.70", or other appropriate size pieces of wood, cut perpendicular to the grain, so the grain runs axial to the 1.70" dimension. Two of these are attached on the opposite sides of one end of a center elongate element, which is a wooden board 1.70"-by-5.75"-by-30" with grain oriented axially lengthwise, fastened using nails, screws, bolts, or adhesive, alone or together. The other two are similarly attached to the other end of the wooden board. These crib elements can then be stacked with the outer plate elements touching, to construct cribbing columns, or cribs, similar to the current practice. Several other configurations for the engineered composite wooden crib element are anticipated by the invention and are included, such as different-sized elements, as well as designs for 3-by-2, 3-by-3, 4-by-4 and other crib configurations.

There are several distinct advantages of the engineered composite wooden crib element as compared to the current solid prismatic wooden crib element. First, since approximately two-thirds of the load-bearing portion of the element is loaded with the wood grain in the axial direction, it is capable of carrying significantly higher loads prior to failure. Laboratory experiments have indicated load carrying capacity to be 200% of the current practice. Second, since the elastic modulus in the axial direction is much higher then the parallel direction, the element has much higher overall stiffness or rigidity. Therefore, it does not allow large roof or floor rock movements prior to developing significant deformation resistance. Third, a 30-inch long engineered composite wooden crib element, as an example, uses about 25% less wood as compared to a typical solid wood prismatic crib element with the same overall dimensions. Larger elements lead to more significant material savings ratios. Therefore, the engineered composite wooden crib element is lighter overall and uses less wood material. The engineered composite wooden crib element is thus easier to carry and assemble in cribs, material costs are reduced, and fewer trees need be harvested to supply the mine with cribbing material. Fourth, because the engineered composite wooden crib element uses less material, it can be assembled in such a way as to reduce the cross-sectional area of the crib and thus significantly reduce resistance to air flow through the crib. This helps with methane removal and other reasons air flow is induced in mines. Fifth, since each crib assembled from engineered composite wooden crib elements can carry more load than typical solid wood element cribs, fewer cribs may be required.

In the example configuration previously mentioned, a 1.70"-by-5.75"-by-30" center elongate element board, connecting the approximately cubical, rectangular prismatic, or disc-shaped outer plate contact blocks, has more than adequate strength to carry tensile and bending stresses. Furthermore, it is convenient and effective to use the center elongate element to lift the engineered composite wooden crib element during the crib construction process. The 1.70"-by-5.75"-by-30" center elongate element board is loaded perpendicular to the grain which would normally yield at a low strength level of 500-700 psi. Since it is squeezed between two pieces of wood that have low Poisson's ratio and it is further vertically and horizontally reinforced by nails, bolts, screws, or other fasteners, or horizontal resistive forces offered by adhesives, or both, the overall board can carry much higher vertical loads prior to yielding or failure. The center board does provide some deformation or yielding behavior within the crib, however. Furthermore, the geometry of the contact area zone in the outer plate element for the engineered composite crib element can be readily changed by changing the size of the wooden pieces connected to a 5.75"-by-1.7"-by-30" wooden piece. For example, the contact area could be made 5.75"-by-7" or 5.75"-by-5.75" or 5.75"-by-8" depending upon the load carrying requirements and lateral stability requirements of the crib. The larger the contact area, the larger would be the load carrying capacity and the lateral stability of the crib structure.

Disadvantages with current crib use can also be overcome if the wedges used for tightening crib elements are: 1) wide and cover the entire area of the contact points, 2) relatively flat so that upon tightening they maintain contact over a large area (preferably over the entire contact area of the prismatic crib element) throughout loading to minimize stress concentrations and localized yielding, and 3) rigid or of high elastic modulus so that they provide large amount of preload for small horizontal displacement of the wedge. These conditions are easily met if 1) wooden wedges are cut so that loading is axial to the wood grain, 2) width of the wedges is the same as or larger than the size of the prismatic element, 3) two mating wedges are used, and 4) wedges are relatively thick (1-2 inches) with very low slope, or incline, angle. For example, based on wood axial elastic modulus of about 250,000 psi, only 0.5 inches horizontal displacement of a wedge with 0.1 degree slope angle will provide about 200 psi of preload. That translates to 3.5 tons of preload on one contact area of a 5.75 inch×5.75 inch crib element, or 14 tons of preload on the crib with four contact points. Similar analyses may be used to design wedges for the entire crib to achieve desired preload.

DETAILED DESCRIPTION OF THE BEST EMBODIMENT

Figure 1:
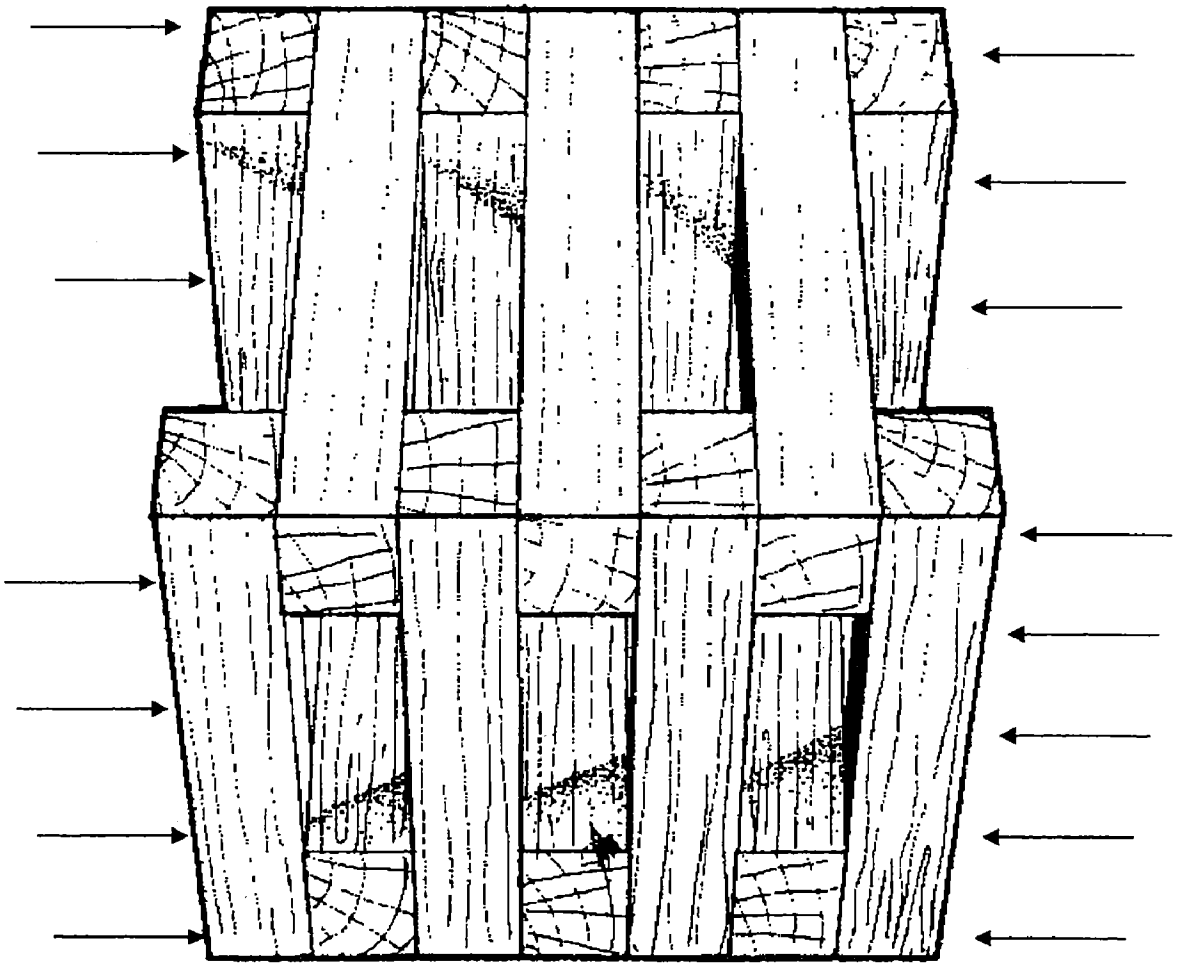
FIG. 1 PRIOR ART
FIG. 1—An isometric view of a traditional wooden crib made from solid wood elements, with arrows showing loading forces.
Figure 7:
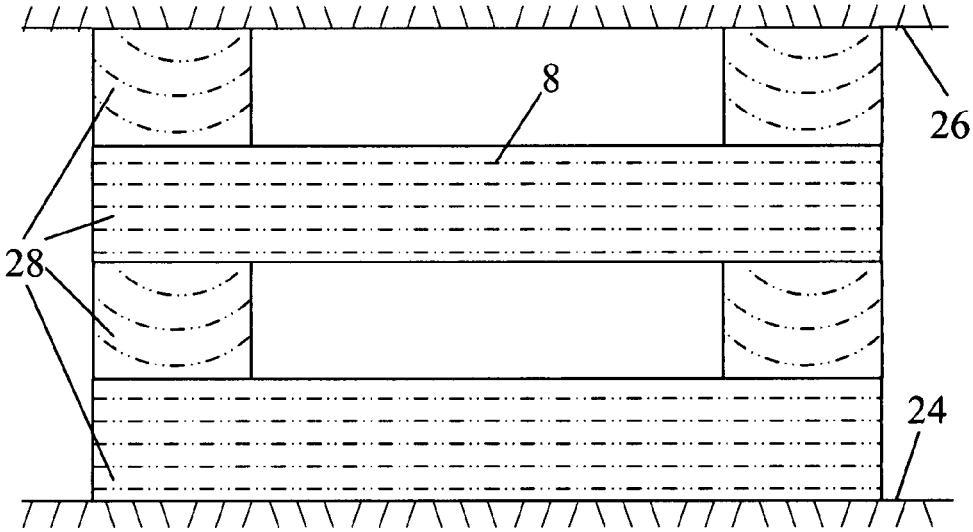
FIG. 7—An elevation view of a traditional solid wood element crib with four layers in a 2 by 2 configuration, showing grain direction.

Referring to the drawings, the invention will be explained in further detail. In FIG. 1, a traditional solid wood element crib is shown. This figure shows a 7-layer crib in a 2 by 2 configuration, with each element parallel to the floor or roof surfaces, and with vertical force lines applied to the crib from the direction of the roof and floor. FIG. 7 shows an elevation view of a four-layer 2 by 2 crib using traditional solid wood elements 28, placed on the floor 24 and stacked up to the roof 26, and showing wood grain direction 8 in each element.

Figure 2:
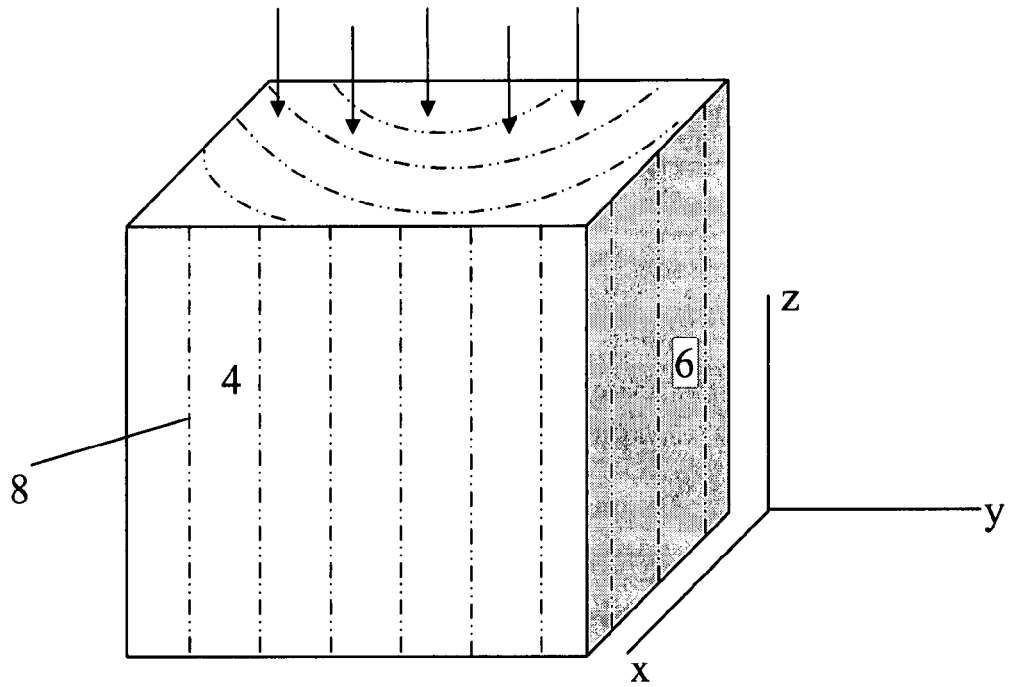
FIG. 2—An isometric view of a 6" by 6" solid wooden block, showing axis and with arrows showing loading forces applied axially with wood grain direction.
Figure 3:
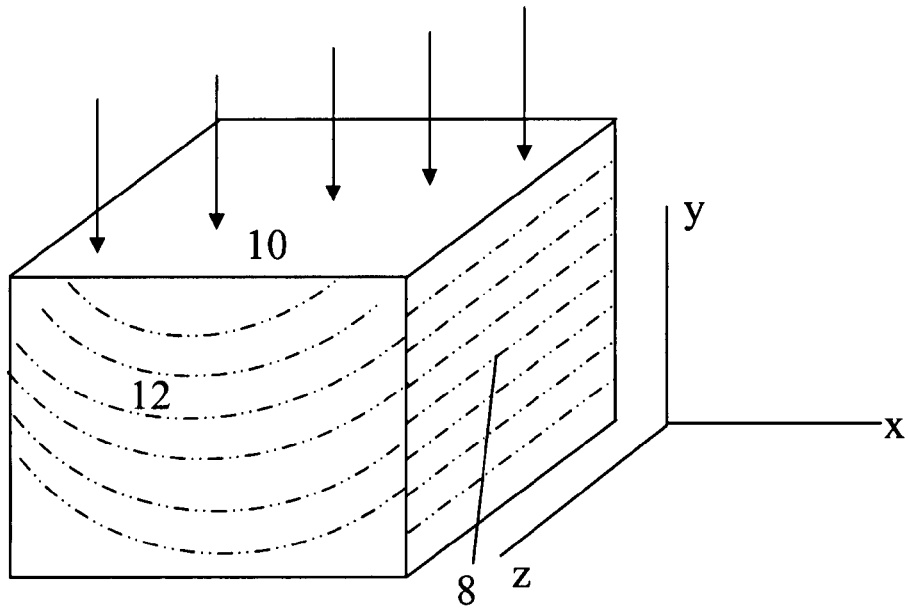
FIG. 3—An isometric view of a 6" by 6" solid wooden block, showing axis and with arrows showing loading forces applied transversally to wood grain direction.
Figure 9:
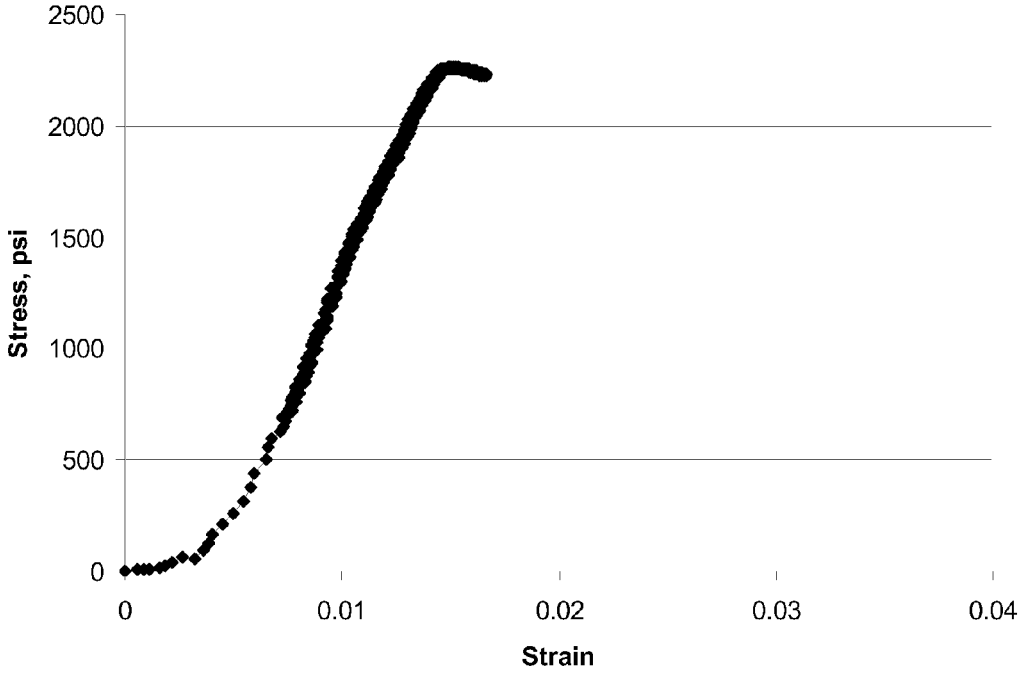
FIG. 9—A stress-strain plot for a 6" by 6" solid wooden block with load applied axially with the grain direction, along the z-axis shown in FIG. 2.
Figure 10:
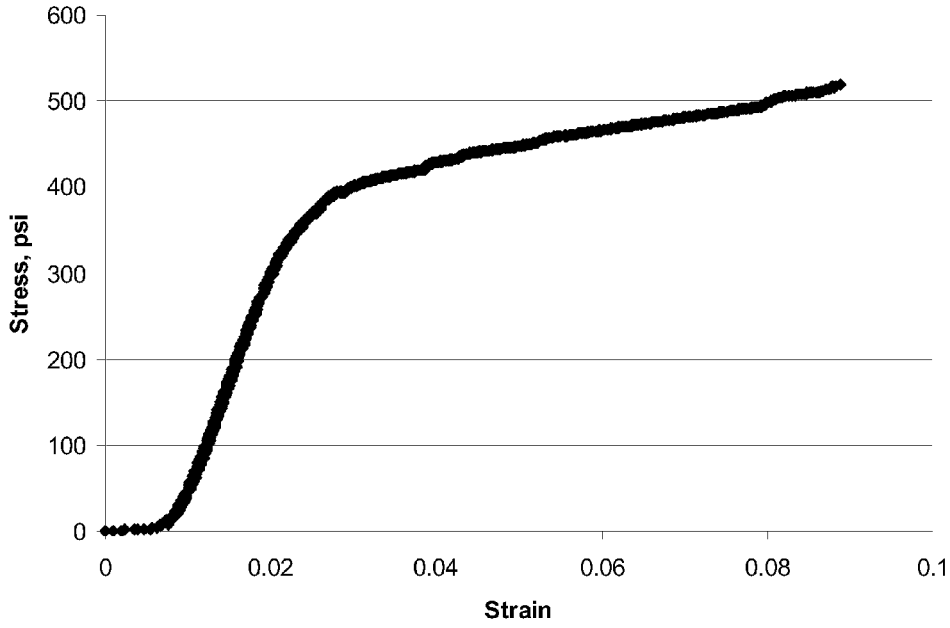
FIG. 10—A stress-strain plot for a 6" by 6" solid wooden block with load applied transversally to the grain direction, along the x-axis.
Figure 11:
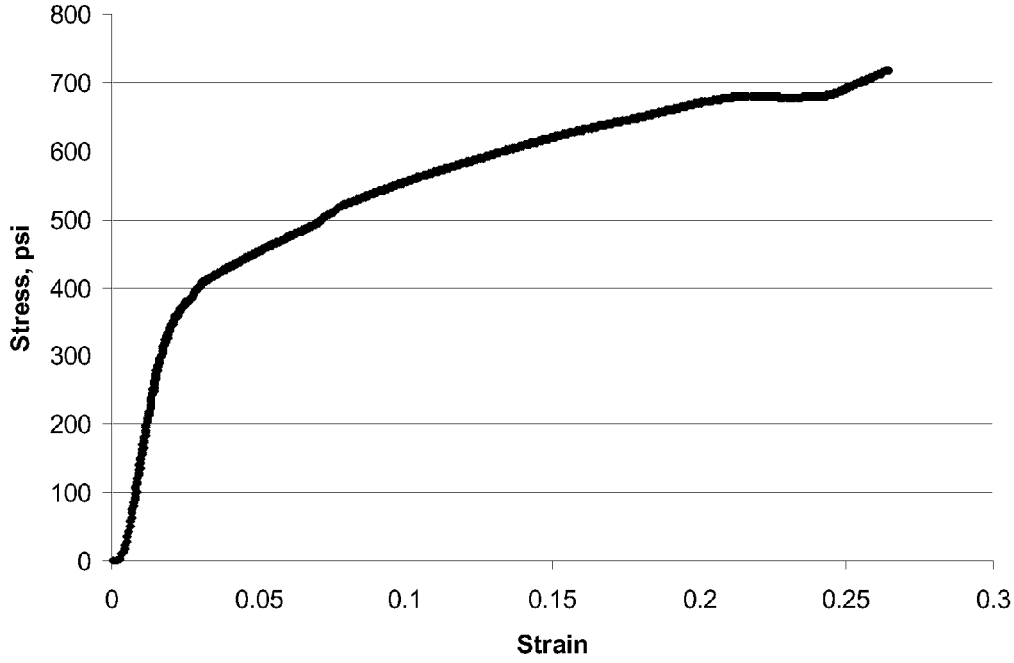
FIG. 11—A stress-strain plot for a 6" by 6" solid wooden block with load applied transversally to the grain direction, along the y-axis as shown in FIG. 3.
Figure 12:
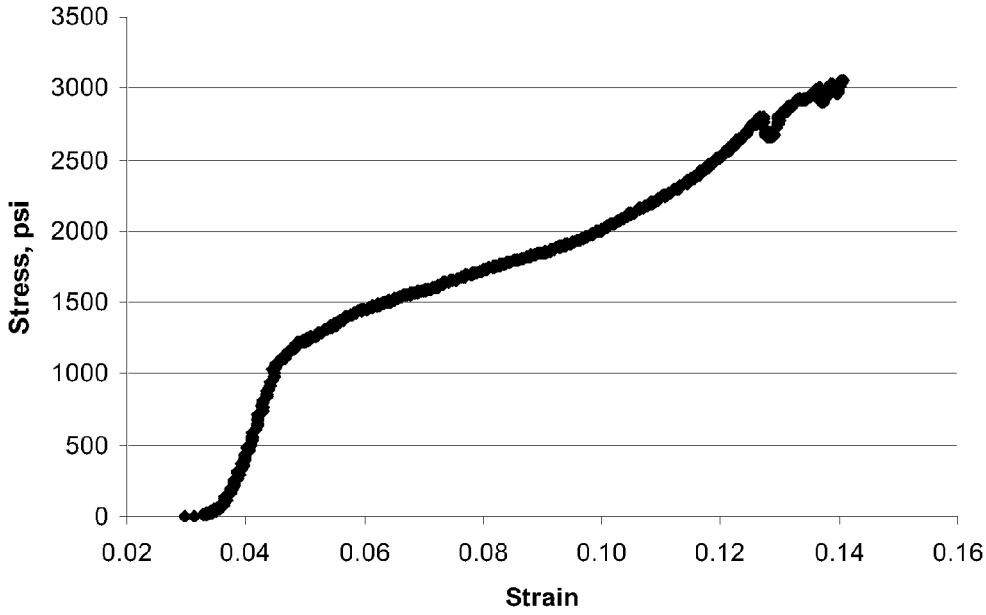
FIG. 12—A stress-strain plot for a 6" by 6" end portion of the engineered composite wooden crib element as shown in FIG. 4.
Figure 13:
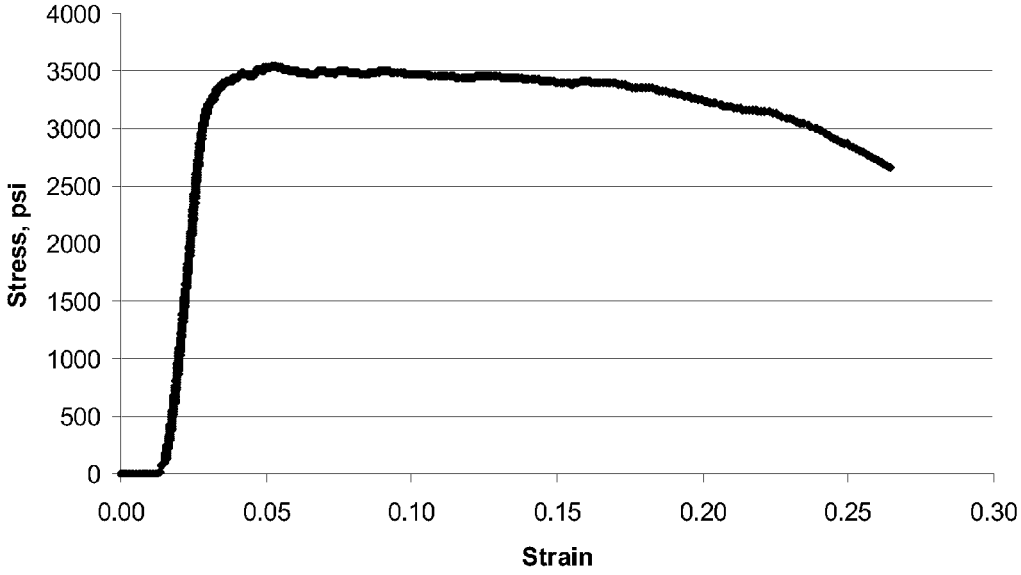
FIG. 13—A stress-strain plot for a 6" by 6" end portion of the engineered composite wooden crib element as shown in FIG. 6.

FIG. 2 shows a drawing of the loading direction in a solid wood element as is used in the typical crib element contained in the crib in FIG. 1. The force is applied to face 10 and is transverse to the grain direction 8 shown in FIG. 2. Face 12 shows the end grain of the block of wood. In this drawing, load is applied along axis y, and the grain runs along axis z. FIG. 11 shows a stress-strain graph of forces along the y axis in a solid 6" by 6" wood block used to simulate forces in a typical solid wood element, as illustrated by FIG. 2. FIG. 10 shows a stress-strain plot which permits the conclusion that loading the block along the x axis leads to similar results as the y axis, as expected, since both load transversally to the grain direction. Wood loaded in this transversal-to-grain direction yields to the forces at much lower levels than when forces are applied axially to the grain direction, as shown in the stress-strain plot of FIG. 9, and illustrated in FIG. 3.

Figure 4:
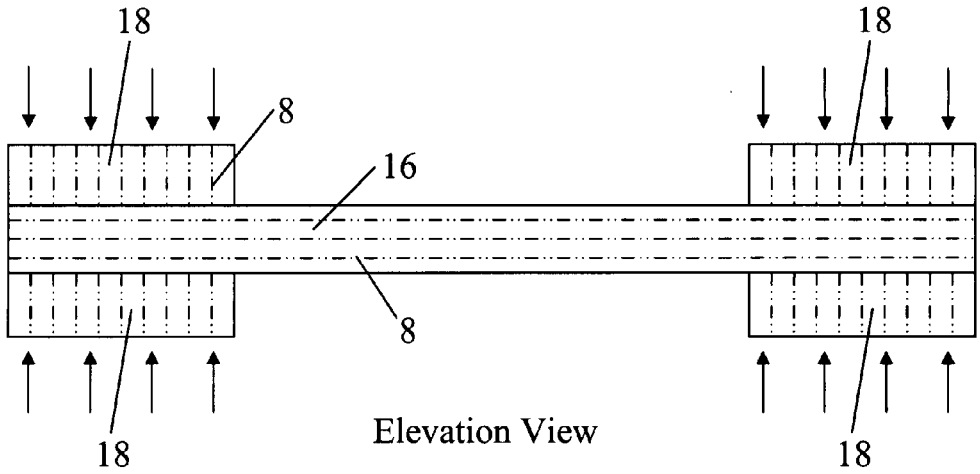
FIG. 4—An elevation view of an engineered composite wooden crib element configuration.
Figure 15:
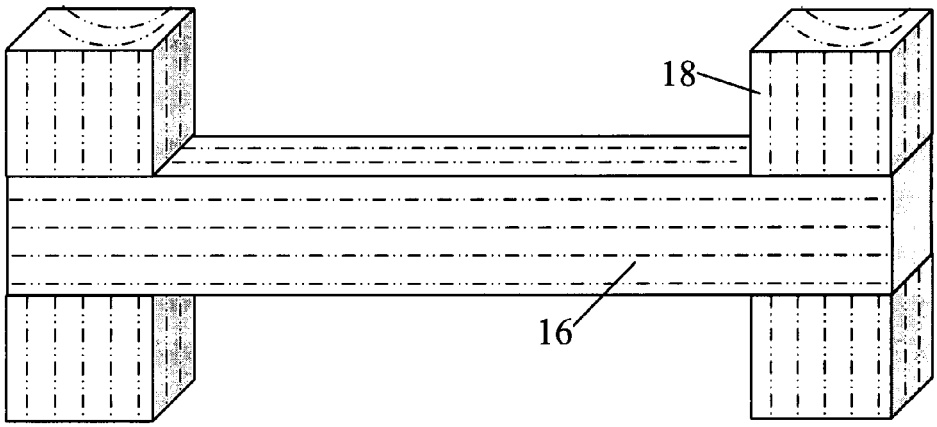
FIG. 15—An isometric view of the preferred embodiment of the engineered composite wooden crib element.
Figure 16:
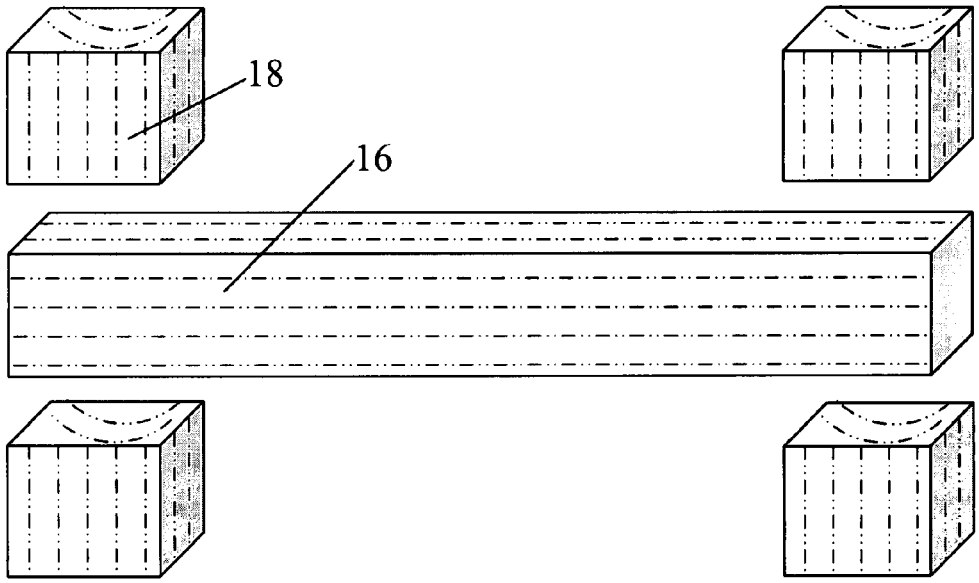
FIG. 16—An exploded isometric view of the preferred embodiment of the engineered composite wooden crib element of FIG. 15.

FIG. 4 shows the configuration of an engineered composite wooden crib element of the preferred embodiment. FIG. 15 shows an isometric view of the same configuration. FIG. 16 shows an exploded view of FIG. 15. It contains center elongate element 16, with grain direction 8 along the length of the element, and four of the outer plate element 18, with grain direction 8 running perpendicular to the grain in the center elongate element 16. In the preferred embodiment, force is applied vertically to each outer plate element 18, which are located vertically to center elongate element 16. A variety of fastening means has been attempted to affix each outer plate element 18 to the center elongate element 16, including screws through drilled holes, nails inserted with an air gun nailer, lag screws or bolts, and adhesives such as phenol resin glue. The preferred embodiment suggests approximately 5 nails evenly distributed across the surfaces to which forces are applied, in a direction parallel to the direction of force and the grain direction of outer plate element 18. The nails in this configuration appear to hold the assembly together in a number of directions, and do not appear to be subject to significant stresses, even when inserted in the direction of the grain without pre-drilling. However, many possible fastening methods are possible, and different ones may have advantages for cost or durability or availability or strength, and all are contemplated. The overall dimensions of the preferred embodiment element closely match the corresponding overall dimensions of a similarly-sized traditional crib element. It is contemplated in the preferred embodiment that the outer plate element 18 would be affixed to the wide face of the center elongate element 16 and that the center elongate element thus is positioned flat or parallel to the floor, and that the outer plate element 18 would be approximately the same width. However, there is benefit to the width of the center elongate element 16 extending beyond the side surface of the outer plate element 18 to provide additional support should the outer plate elements 18 deform outward under extreme pressure.

Figure 5:
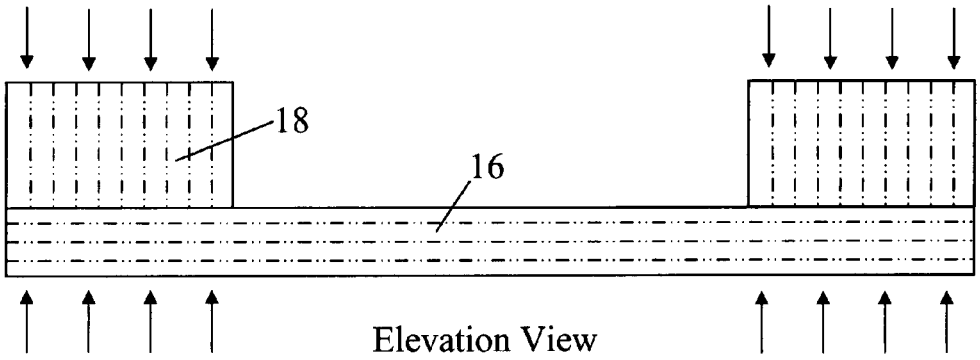
FIG. 5—An elevation view of an alternative configuration for an engineered composite wooden crib element.

FIG. 5 shows an alternative configuration of the engineered composite wooden crib element, wherein only two outer plate elements are used instead of four, and both are affixed to the same surface of center elongate element 16 and are loaded axially to the grain in the outer plate. This configuration uses outer plate elements 18 which are approximately twice the thickness of each of those in the preferred embodiment, which has outer plate elements 18 affixed to opposite surfaces of the center elongate element 16. In this configuration, the total thickness of the outer plate element 18 along the load direction is approximately equal to the total thickness of the outer plate element 18 along the load direction in the preferred embodiment shown in FIG. 4. When the outer plate is loaded, however, the load-carrying capability of this configuration is compromised. It appears that since only one set of fastening nails is used with the single-thickness configuration of FIG. 5, as compared to two sets with the double-thickness configuration of FIG. 4, the reduced holding power permits more lateral deformation of the outer plate element 18, leading to lower load-carrying capacity.

Figure 6:
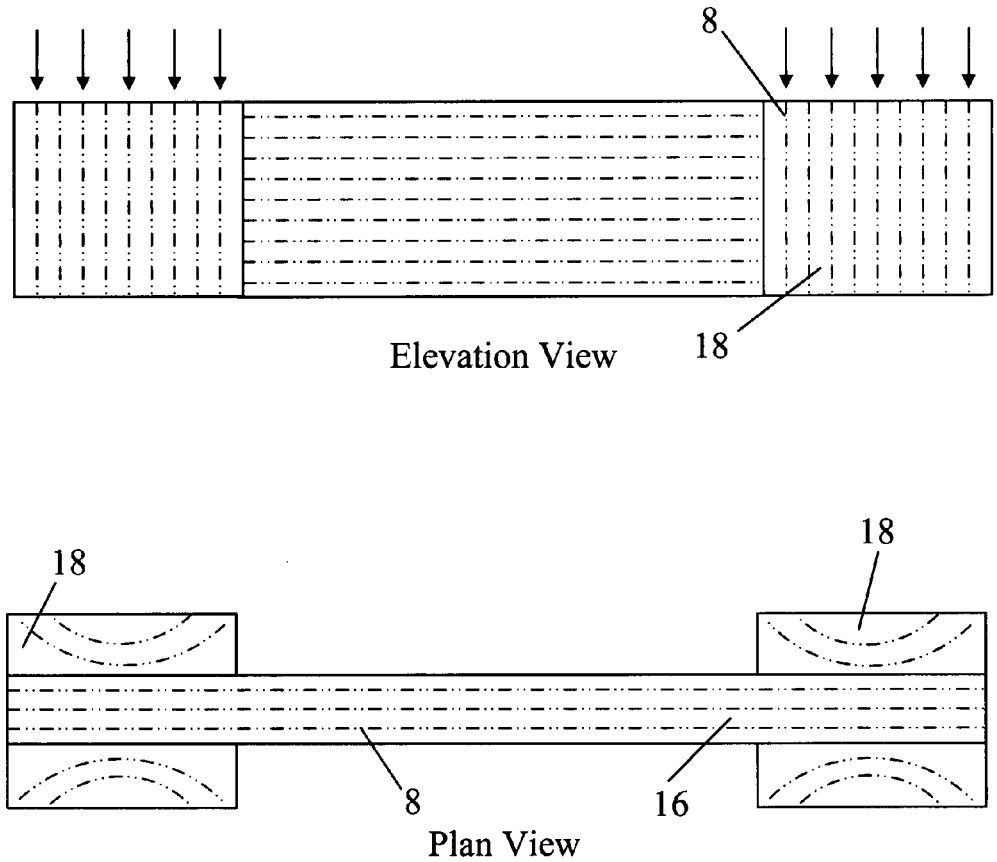
FIG. 6—An elevation view of another alternative configuration for an engineered composite wooden crib element.

FIG. 6 shows another alternative configuration of the engineered composite wooden crib element, wherein the center elongate element 16 is oriented on-edge, so that the wide surface is vertical, and each of four outer plate elements 18 are affixed as shown, and loaded as shown by loading forces in the elevation view. In this configuration, the grain direction 8 in the outer plate element 18 is oriented so that the vertical load is still applied axially to the grain direction 8. But the center elongate element 16 carries load across its width, rather than thickness. The load carrying capability of this configuration was little higher than the traditional prior art crib element, with substantial deformation of the outer plate elements 18 from shear forces.

The various configurations, as well as the possibility of altering the length, width and thickness of each component in the engineered composite wooden element permits one to engineer the precise load-carrying and stiffness characteristics desired for a particular application. In some cases, deformation of the floor and roof surfaces is desirable, for example, where in other situations, no deformation is desired. Because the stress-strain characteristics of different types and sizes of wood are well known, they can be combined in an infinite number of ways to engineer the strength and stiffness characteristics of the crib using engineered composite wooden elements.

Figure 8:
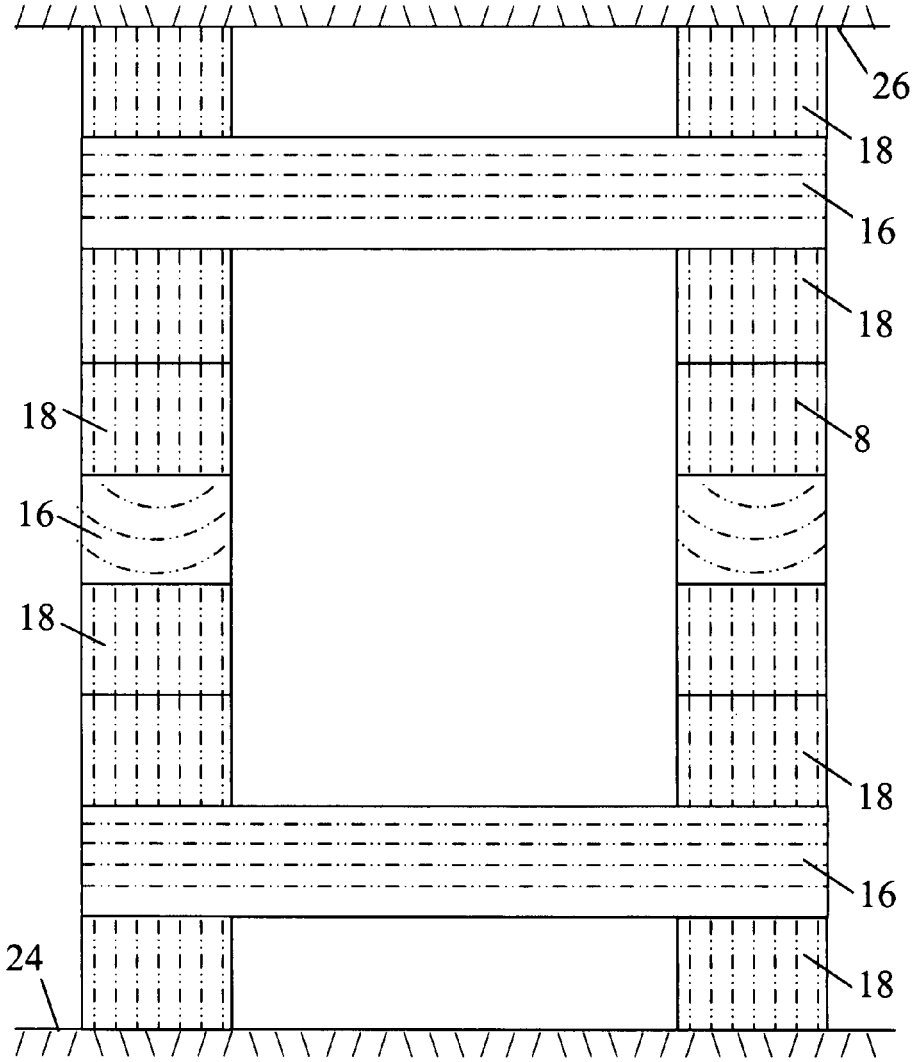
FIG. 8—An elevation view of an engineered composite wooden crib with three layers in a 2 by 2 configuration, showing grain direction in crib elements, installed between floor and roof surfaces.
Figure 14:
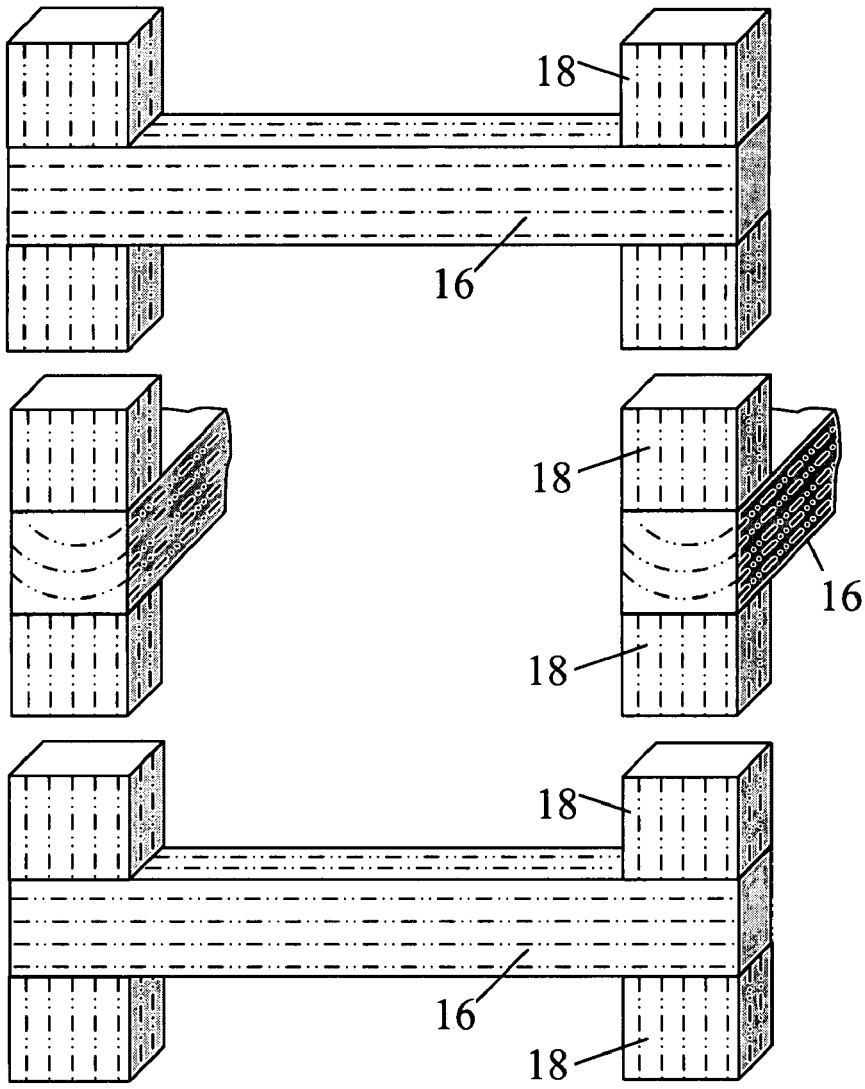
FIG. 14—A partial exploded isometric view of an assembled engineered composite wooden crib as shown in FIG. 8.

FIG. 8 shows an elevation view of an assembled crib using the preferred embodiment of engineered composite wooden elements, in a 3-layer 2 by 2 configuration. The elements are layered from floor 24 up to roof 26, and show the relative placement of center elongate element 16 and outer plate element 18 and their relationship to other elements of other crib elements. FIG. 14 shows an exploded isometric view of the same structure of FIG. 8, to see that outer plate element 18 from one element rests against outer plate element 18 in the adjoining layer.

Figure 17:
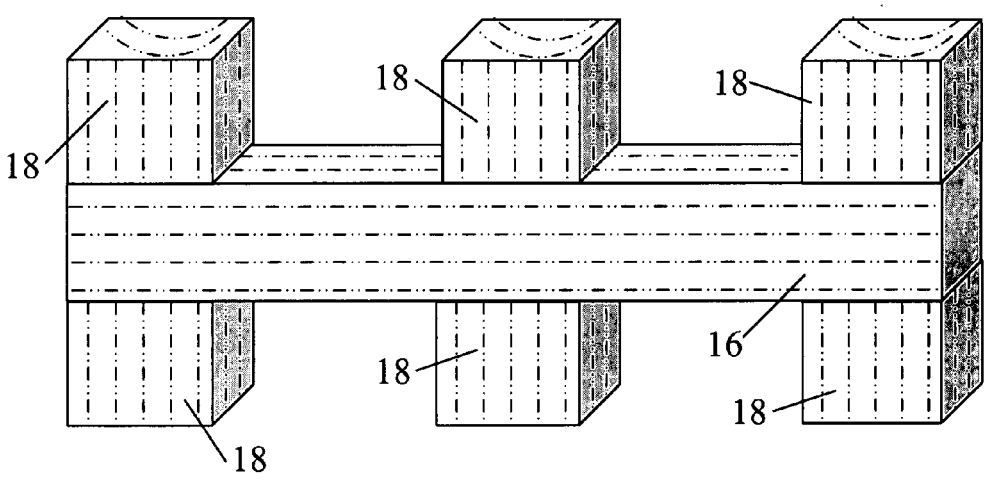
FIG. 17—An isometric view of an alternative configuration of the engineered composite wooden crib element.
Figure 18:
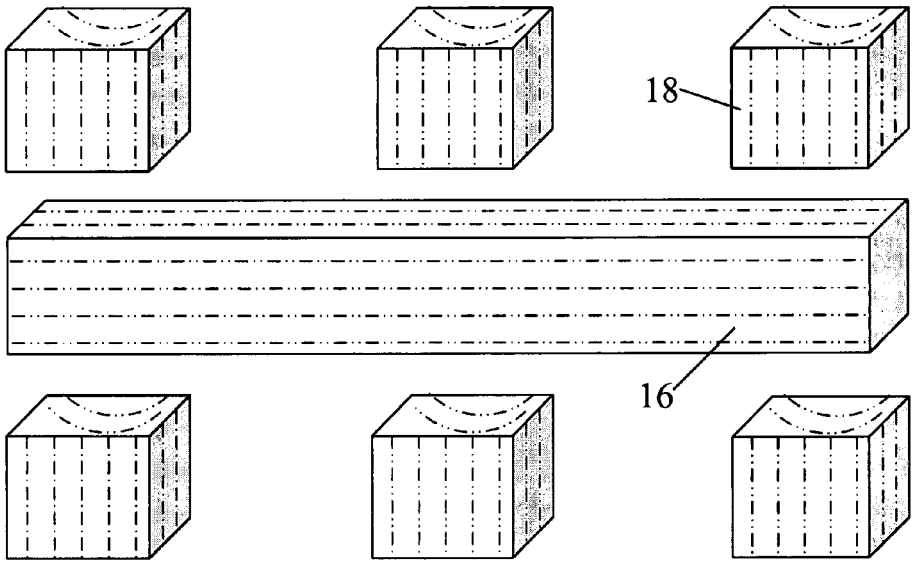
FIG. 18—An exploded isometric view of the preferred embodiment of the engineered composite wooden crib element of FIG. 17.

FIG. 17 shows an isometric view of yet another possible embodiment of the invention. This figure shows an additional pair of outer plate elements 18 affixed along the length of the center elongate element 16. Additional quantities are possible as well. In the configuration of FIG. 17, the crib element would be used to create either a 2 by 3 stack or a 3 by 3 stack. For a 2 by 3 stack, the element would be combined with the crib element of FIG. 15. FIG. 18 shows an exploded isometric view of the configuration of FIG. 17.

Figure 19:
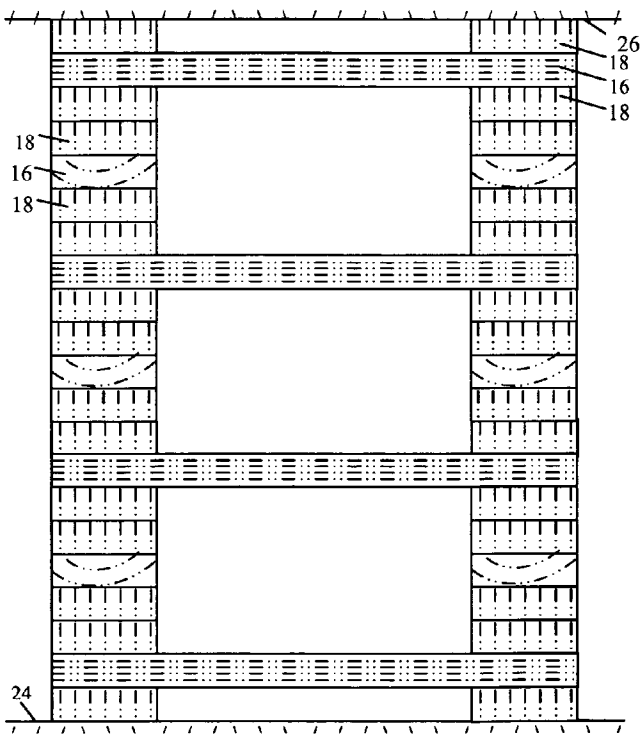
Prior Art FIG. 19
FIG. 19—An elevation view comparing a typical solid wood element 8-layer 2 by 2 crib from prior art with a 7-layer, 2-by-2 engineered composite wooden crib of the present invention, showing wood grain direction in different elements.
Figure 19:
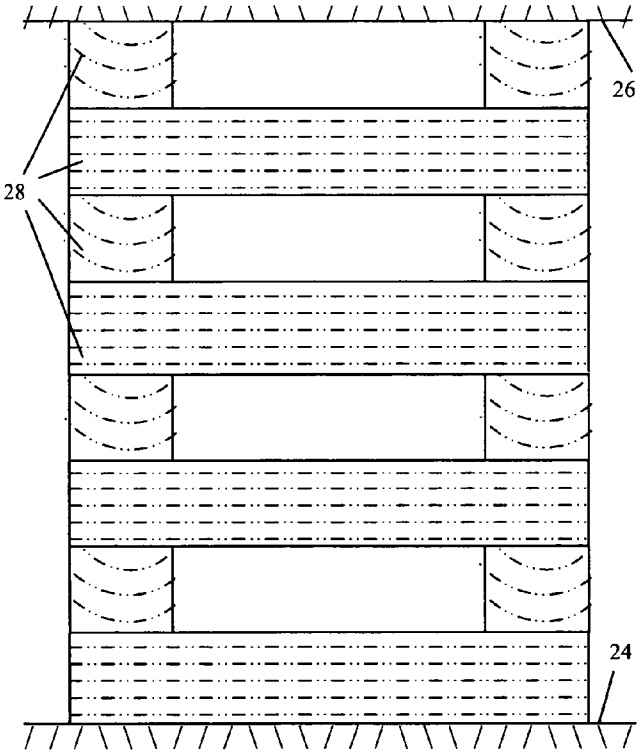
Prior Art FIG. 19

FIG. 19 shows an elevation view of two cribs side-by-side. The 8-layer solid wood element traditional crib is shown beside a 7-layer crib using the preferred embodiment crib element of the invention. It can be seen in this view that the cross-sectional profile of the crib constructed from the preferred embodiment has substantially less material in cross-section to obstruct airflow along the direction of the roof and floor. It is important to decrease resistance to airflow around cribs to permit maximum airflow through the mine, and the preferred embodiment provides this quality while also providing increased load-carrying capacity, increased stiffness, and reduced raw materials being used.

Figure 20:
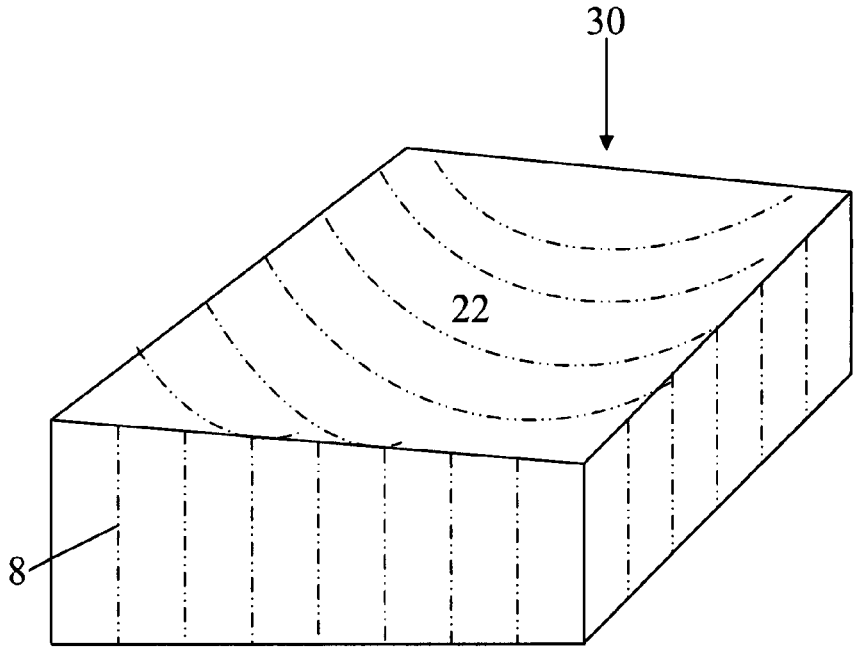
FIG. 20—An isometric view of an engineered wedge used in the present invention, showing wood grain direction.

FIG. 20 shows an isometric view of a wedge 30 of the invention, used to establish preload forces on the assembled crib using the crib elements of the invention. Surface 22 is in a low incline with its opposing surface, both of which come in contact with outer plate elements 18 of the engineered composite wooden element, or other wedges or spacers. This low incline angle, which is not typical of traditional wood wedges used to preload traditional cribs, helps maximize the load-carrying surface area of the wedge when inserted between layers of the crib. The surface 22 area is most effective when it is no smaller than the surfaces of outer crib elements 18 against which it rests. Finally, the grain direction 8 of the wedge is axial to the loading direction the wedge experiences, which is different from traditional wedges in use in industry. This grain direction, increased contact area, and low incline angle combine to yield significantly increased load carrying capacity of the wedge over traditional preload wedges. This permits the crib constructed from engineered composite wooden crib elements to be preloaded to a much higher load level. In experiments this load was measured as over 8 tons, as compared to approximately 2 tons for traditional cribs of the same configuration. This, in combination with the increased stiffness of the crib constructed from engineered composite wooden crib elements to support the forces exerted between the floor and roof without deformation, as compared to traditional wood cribs.

Figure 21:
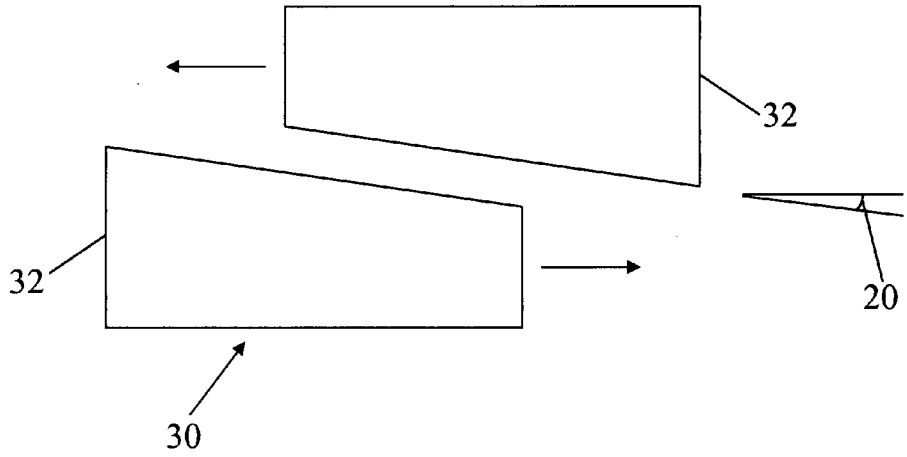
FIG. 21—An elevation view of two engineered wedges used together between crib layers to increase preload, showing direction of travel to increase vertical loading forces.

FIG. 21 shows an elevation view of a pair of wedges 30 of the invention, as they are used at one contact area between two layers of a crib constructed from engineered composite wooden crib elements. One wedge 30 is position above the other, with surfaces 22 touching. Force is then applied to surface 32, the side surface with the greatest area, to drive the upper wedge into place to increase preload forces. The wedges 30 may also be affixed to center elongate element, in place of an outer plate element.

I claim:

1. A wooden crib element comprising: a center elongate element wherein the wood grain runs transversely to the crib element loading direction; and at least two outer plate elements wherein the wood grain runs axially with the crib element loading direction, and wherein each outer plate element is affixed to a surface of said center elongate element using fastening means and said outer plate element wood grain direction is aligned transversely to the grain direction in said center elongate element.

2. The wooden crib element of claim 1 further comprising at least two of said outer plate elements affixed to said center elongate element such that said outer plate elements are affixed to a surface of said center elongate element with each of at least one pair of outer plate elements is located substantially near opposite ends of the length of said center elongate element.

3. The wooden crib element of claim 2 wherein said outer plate elements are wooden wedges wherein grain in said wooden wedges runs axially with loading direction and wherein said wooden wedges have an incline angle of less than 30 degrees between load-bearing surfaces.

4. The wooden crib element of claim 1 further comprising two pairs of said outer plate elements wherein each pair is affixed to opposing surfaces of said center elongate element and one of each pair is located substantially near opposite ends of the length of said center elongate element.

5. The wooden crib element of claim 1 further comprising two sets of three or more of said outer plate elements, wherein each of said sets is affixed on opposing surfaces of said center elongate element, and wherein within each set of said outer plate elements two of said outer plate elements are each affixed substantially near opposing ends of the length of said center elongate element and the remaining said outer plate elements are affixed substantially along, the length of said center elongate element.

6. The wooden crib element of claim 1 wherein the dimensions of said center elongate element and said outer elements depend on the strength and deformation characteristics of the particular wood variety used and that are required for a particular application.

7. The wooden crib element of claim 1 further comprising overall dimensions of said wooden crib support element that are less than 10 inches by 10 inches by 84 inches but more than 4 inches by 4 inches by 12 inches.

8. A method of using the crib element of claim 4 to construct a crib support column comprising:

locating a layer of said wooden crib elements, said layer consisting of at least two of said wooden crib elements parallel to each other and spaced apart an overall distance approximately equal to the length of said wooden crib element, substantially parallel to a footwall, floor, or lower surface, wherein said wooden crib element is oriented with said outer elements positioned on the bottom and top of said center element;

stacking additional layers to reach and substantially contact a hanging wall, roof or upper surface, each layer consisting of at least two of said wooden crib elements at right angles to said pair of said wooden crib elements immediately beneath and with said outer elements positioned on the bottom and top of said center element, such that each outer element of said wooden crib element contacts with one of said outer elements of said wooden crib element immediately beneath.

9. The method of claim 8 further comprising constructing the cribbing support column using prismatic solid wood crib elements as the lowest layer directly in contact with a floor, foot wall or lower surface.

10. The method of claim 8 further comprising constructing the cribbing support column using prismatic solid wood crib elements, alone or in combination with shims or spacers, as the highest layer directly in contact with a roof, hanging wall, or upper surface.

11. The method of claim 8 further comprising:

using at least one wooden wedge to establish vertical preload on the cribbing support column wherein the grain in said wooden wedge runs axially with loading direction and wherein said wooden wedge has an incline angle of less than 30 degrees;

inserting at least one of said wooden wedge wherein said wooden wedge is located between said layers; and applying force to said wooden wedge to push said wooden wedge further between said layers so as to increase vertical preload forces in said cribbing support column.

12. The method of claim 11 further comprising using said wooden wedges in adjoining pairs inserted from opposite directions between said layers of said wooden crib elements.

13. The method of claim 12 wherein one of each pair of said wedges is affixed to said center elongate element of said wooden crib element in place of said outer plate element.

14. The method of claim 11 further comprising wooden wedges with an incline angle of less than 10 degrees.

15. The method of claim 8 further comprising:

using at least one wooden wedge to establish preload on the cribbing support column wherein the grain in said wooden wedge runs axially with loading direction and wherein said wooden wedge has an incline angle of less than 10 degrees;

inserting at least one of said wooden wedge in between said layers of said crib elements wherein said wooden wedge is located between said layers; and applying force to said wooden wedge to push said wooden wedge further between said layers so as to increase preload forces in said cribbing support column.

16. The method of claim 11 further comprising inserting said wooden wedges between layers located approximately mid-way between floor, footwall, or lower surface and roof, hanging wall, or upper surface on said wooden support cribbing column.

17. A method of making the wooden crib element of claim 1 comprising:

machining said center elongate element to length of 12 to 84 inches, width of one-half to 18 inches and thickness of one-eighth inches to twelve inches, with grain running longitudinally;

machining each of said outer plate elements to width of 3 to 12 inches and length of 3 to 18 inches and thickness of 1/64 inches to eight inches with grain running axially with the thickness;

attaching said outer plate elements to said center element using screws, nails, bolts or adhesive fasteners either alone or in combination, such that at least one of said outer plate elements are each located near an end of said center elongate element and located such that the grain in said outer plate element is perpendicular to grain of said center element, and affixed to a surface of said center elongate element having a width of one-half to 18 inches.

18. A method of making the wooden crib element of claim 2 comprising:

machining said center elongate element to length of 12 to 84 inches, width of one-half to 18 inches and thickness of one-eighth inches to twelve inches, with grain running longitudinally;

machining each of said outer plate elements to width of 3 to 12 inches and length of 3 to 18 inches and thickness of 1/64 inches to eight inches with grain running axially with the thickness, with said outer plate element formed in the shape of a wedge with an incline of less than 20 degrees between the surfaces axial to the grain direction;

attaching said outer plate elements to said center element using screws, nails, bolts or adhesive fasteners either alone or in combination, such that at least one of said outer plate elements are each located near an end of said center elongate element and located such that the grain in said outer plate element is perpendicular to grain of said center element, and affixed to a surface of said center elongate element having a width of one-half to 18 inches.

* * * * *